US009725917B2

(12) United States Patent
Huh

(10) Patent No.: US 9,725,917 B2
(45) Date of Patent: Aug. 8, 2017

(54) RESTORATIVE WATERPROOFING MEMBRANE AND METHOD OF FORMING THE SAME

(71) Applicant: John Huh, Plymouth, MN (US)

(72) Inventor: John Huh, Plymouth, MN (US)

( * ) Notice: Subject to any disclaimer, the term of this patent is extended or adjusted under 35 U.S.C. 154(b) by 0 days.

(21) Appl. No.: 15/150,218

(22) Filed: May 9, 2016

(65) Prior Publication Data

US 2016/0326759 A1 Nov. 10, 2016

Related U.S. Application Data

(60) Provisional application No. 62/159,207, filed on May 8, 2015.

(51) Int. Cl.
*E04G 23/02* (2006.01)

(52) U.S. Cl.
CPC ..... *E04G 23/0288* (2013.01); *E04G 23/0211* (2013.01)

(58) Field of Classification Search
CPC ..... E04G 23/0203; E04G 23/0211; E04G 23/0229; E04G 23/02; E04G 23/00; E04G 23/0288; E02D 19/16; E02D 37/00; E02D 3/12; E02D 2250/003; E02D 5/46; E02D 31/10; E02D 31/004; E02D 19/22; E02D 15/04; E02D 5/34; B32B 5/26; E21D 11/38; E21D 11/00; E21D 11/383; B29C 65/52; B05B 1/24; E01C 21/00; B27K 3/10; B27K 5/001
USPC ... 52/741.13, 741.41, 741.4, 742.13, 742.16, 52/514.5, 2.13, 749.1; 156/94; 425/11, 425/13; 264/36.2, 46.6, 46.5; 404/78,
(Continued)

(56) References Cited

U.S. PATENT DOCUMENTS 1,883,196 A * 10/1932 Wertz ..... E04G 23/0203 264/155
2,071,758 A * 2/1937 McKay ..... E04B 1/648 52/741.13

(Continued)

FOREIGN PATENT DOCUMENTS

CN WO 2011147173 A1 * 12/2011 ..... C10G 11/18

OTHER PUBLICATIONS

Re-Systems Group, Americas, 07140-1 Liquid Applied Waterproofing Membrane SYstem, specification guide, publically available at least as early as Dec. 31, 2013, 6 pages.*

(Continued)

*Primary Examiner* — Beth Stephan
(74) *Attorney, Agent, or Firm* — Skaar Ulbrich Macari, P.A.

(57) ABSTRACT

Disclosed is a method, process and system for sealing cracks in concrete substrates such as walls and floors. A plurality of holes are drilled through the concrete substrate, with at least one hole on each opposing side of the crack. Then a polymer rubber gel that is thick enough to not flow at room temperature (e.g. comprising 99% solids) is heated in a tank to an elevated temperature (e.g. 120-200° F.). Next, the heated polymer rubber gel is pumped in the heated state through one of the holes in the concrete. The pumping continues until the polymer rubber gel is observed exiting a second drilled hole that is spaced apart from the injecting hole. The polymer rubber gel rapidly cools and solidifies, thereby forming a waterproofing membrane that seals the crack(s).

17 Claims, 2 Drawing Sheets

(58) Field of Classification Search
USPC ..... 404/108, 83, 95, 101; 405/146; 222/146.1, 146.2, 207, 211; 239/13; 118/50
See application file for complete search history.

(56) References Cited

U.S. PATENT DOCUMENTS 2,074,756 A * 3/1937 Poulter ..... E01C 23/10 404/108
2,313,110 A * 3/1943 Wertz ..... B28B 23/0081 264/128
2,996,467 A * 8/1961 Hawley ..... C08L 95/00 524/60
3,545,213 A * 12/1970 Hofbauer ..... E21D 11/04 138/105
3,900,102 A * 8/1975 Hurst ..... C09J 7/0271 156/71
3,903,040 A * 9/1975 Politte ..... C08F 279/02 525/242
4,049,853 A * 9/1977 Tortolo ..... B32B 19/04 156/145
4,352,262 A * 10/1982 Edelmann ..... E04G 23/0203 138/125
4,360,994 A * 11/1982 Hodges ..... E04G 23/0203 264/36.2
4,509,884 A * 4/1985 Trout ..... E04G 23/0203 141/293
4,622,085 A * 11/1986 Yamada ..... E04G 23/0203 141/1
4,695,188 A * 9/1987 Pulkkinen ..... E21D 11/383 405/146
4,744,193 A * 5/1988 Hatsuzaki ..... C08G 18/168 405/264
4,861,401 A * 8/1989 Miura ..... E04G 23/0203 156/94
4,943,185 A * 7/1990 McGuckin ..... E02D 31/02 210/170.07
4,986,862 A * 1/1991 Matsufuru ..... B05C 17/005 141/1
5,033,952 A * 7/1991 Haug ..... F16B 13/00 405/259.5
5,063,006 A * 11/1991 Tahara ..... E04G 23/0203 264/35
5,155,965 A * 10/1992 Tabei ..... E04G 23/0203 156/94
5,185,013 A * 2/1993 Martin ..... E04G 23/0203 156/94
5,186,949 A * 2/1993 Lai ..... E04G 23/0203 156/94
5,253,957 A * 10/1993 Fujikawa ..... E04G 23/02 264/36.2
5,257,486 A * 11/1993 Holmwall ..... B05C 7/00 156/293
5,435,669 A * 7/1995 Weber ..... E02D 29/025 405/284
5,436,396 A * 7/1995 Bailey ..... C08K 3/0033 405/264
5,496,615 A * 3/1996 Bartlett et al. ..... C09J 7/02 428/144
5,622,023 A * 4/1997 Crispino ..... E04D 15/07 239/130
5,655,350 A * 8/1997 Patton ..... E04B 2/7411 52/404.1
5,948,444 A * 9/1999 Naito ..... E04G 23/0203 425/11
6,122,887 A * 9/2000 Massett ..... E02D 31/02 52/169.11
6,226,948 B1 * 5/2001 Trout ..... E04G 23/0203 173/90
6,301,851 B1 * 10/2001 Matsubara ..... E04B 1/0015 52/309.7
6,309,493 B1 * 10/2001 Braun ..... E04G 23/0203 156/247
6,405,508 B1 * 6/2002 Janesky ..... E04G 23/0203 52/514.5
6,532,714 B1 * 3/2003 Ferm ..... E01C 7/147 404/64
6,634,831 B2 * 10/2003 Canteri ..... E02D 3/12 405/263
6,767,164 B2 * 7/2004 Shimizu ..... E21D 11/383 405/150.1
6,793,441 B2 * 9/2004 Shimizu ..... E21D 11/383 405/146
6,976,804 B1 * 12/2005 Asplin ..... E01C 23/10 404/78
7,226,274 B1 * 6/2007 Asplin ..... F04B 15/023 417/203
7,461,997 B1 * 12/2008 Mack, II ..... E01C 23/10 404/101
7,462,001 B2 * 12/2008 Canteri ..... E04B 1/648 405/263
7,488,523 B1 * 2/2009 Muncaster ..... B32B 11/04 404/17
7,516,592 B1 * 4/2009 Pratt ..... E02D 37/00 52/169.14
7,698,858 B2 * 4/2010 Schroer ..... E04H 9/145 405/36
7,882,671 B2 * 2/2011 Bruce ..... B32B 27/12 264/173.11
8,087,210 B2 * 1/2012 Agneloni ..... E04G 23/0218 156/71
8,186,907 B1 * 5/2012 Asplin ..... E01C 23/10 404/78
8,487,033 B2 * 7/2013 Van Hoyweghen .... C08L 23/10 524/493
8,683,773 B2 * 4/2014 Emmons ..... E04B 1/6812 52/2.13
9,151,066 B1 * 10/2015 Hilton ..... E04G 23/0285
9,194,140 B2 * 11/2015 Hemphill ..... E04G 23/0218
9,410,335 B2 * 8/2016 Stubblefield ..... E04G 23/0203
2003/0062427 A1 * 4/2003 Bien ..... E01C 19/08 239/135
2005/0023296 A1 * 2/2005 Bien ..... B01F 15/042 222/146.1
2005/0079016 A1 * 4/2005 Greenwood ..... C04B 28/26 405/266
2006/0096503 A1 * 5/2006 Lee ..... C08L 95/00 106/670
2007/0050963 A1 * 3/2007 Keller ..... B23P 6/04 29/402.12
2007/0193167 A1 * 8/2007 Bruce ..... B32B 27/12 52/408
2008/0105195 A1 * 5/2008 Vaerewyck ..... B27K 3/0278 118/50
2008/0287588 A1 * 11/2008 Van Hoyweghen .... C08L 23/10 524/493
2008/0289289 A1 * 11/2008 Wiercinski ..... B32B 27/12 52/745.06
2009/0197042 A1 * 8/2009 Polk ..... B32B 3/266 428/137
2011/0277393 A1 * 11/2011 Hohmann, Jr. ..... B32B 33/00 52/62
2012/0085063 A1 * 4/2012 Pufahl ..... B32B 3/30 52/741.4
2012/0159893 A1 * 6/2012 Anderson ..... E02D 29/02 52/741.13
2012/0196956 A1 * 8/2012 Lee ..... C08K 3/0033 524/8
2012/0261052 A1 * 10/2012 Lecoultre ..... C04B 41/009 156/71
2014/0137503 A1 * 5/2014 Wheatley ..... E04G 23/0214 52/514.5
2014/0272238 A1 * 9/2014 Hohmann, Jr. ..... E04B 1/7046 428/41.8
2015/0068154 A1 * 3/2015 Merlob ..... E04G 23/0218 52/741.1

(56) References Cited

U.S. PATENT DOCUMENTS

2015/0197909 A1* 7/2015 Huh ..... E02D 3/123
405/270
2015/0300033 A1* 10/2015 Weber ..... E04G 23/0214
52/514
2016/0097278 A1* 4/2016 Huh ..... E21D 11/383
405/150.2

OTHER PUBLICATIONS

Re-Systems Group, Americas, brochure for Turbo-Seal, GT-350—Features Benefits Sheet, publically available at least as early as Dec. 31, 2013, 6 pages.*
Re-Systems Group, Americas, brochure for Turbo-Seal Gel Tech Systems, Apr. 21, 2011, 1 page.*
Re-Systems Group, Americas, Turbo-Seal Contractor Refernece Guide, Sep. 1, 2011, 5 pages.*
U.S. Appl. No. 14/596,908, non-final rejection Mar. 11, 2105.*
U.S. Appl. No. 14/596,908, final rejection Jul. 10, 2015.*
U.S. Appl. No. 14/596,908, final rejection Dec. 16, 2015.*
U.S. Appl. No. 14/876,783, non final rejection Mar. 20, 2017.*

* cited by examiner

RESTORATIVE WATERPROOFING MEMBRANE AND METHOD OF FORMING THE SAME

PRIORITY

This application claims the priority benefit of U.S. Provisional Application No. 62/159,207 filed on May 8, 2015, which is hereby incorporated herein by reference in its entirety.

FIELD

The present invention relates generally to systems and methods for repairing water leaks in concrete substrates, such as in walls and floors.

BACKGROUND

Concrete is widely used to form building structures such as walls and floors. When these concrete building structures are below grade, they are susceptible to water infiltration. Water seeks to penetrate via a path of least resistance, so cracks in the concrete wall or floor provide an easy path for water to penetrate and reach the interior space of the structure.

Attempts have been made to patch cracks in concrete with mortar or the like, but the patch material is difficult to apply due to the presence of water in the location to be patched. Thus, the patch is susceptible to failure.

Other known solutions are to drill holes in the concrete substrate and inject mud, concrete or a chemical grout under pressure in order to cause the material to flow behind the substrate and hopefully seal the crack(s). One injected chemical grout attempted is a room-temperature flowable polymer rubber gel with the brand name TURBOSEAL. This material is composed of approximately 78% solids, so it will flow at room temperature. These methods have had some measure of success, but there is a continuing need to find even better solutions to seal concrete cracks.

SUMMARY

The present invention provides a method and system for sealing cracks in concrete substrates such as walls and floors. A plurality of holes are drilled through the concrete substrate, with at least one hole on each opposing side of the crack. Then a polymer rubber gel that is thick enough that it does not flow at room temperature (e.g. comprising 99% solids) is heated in a tank to an elevated temperature (e.g. 120-200° F.). Next, the heated polymer rubber gel is pumped in the heated state through one of the holes in the concrete. The pumping continues until the polymer rubber gel is observed exiting a second drilled hole that is spaced apart from the injecting hole. The polymer rubber gel rapidly cools and solidifies, thereby forming a waterproofing membrane that seals the crack(s).

The disclosure includes a method of providing a restorative waterproofing membrane to a distal side of a concrete substrate that includes a crack through the substrate from a proximal side to the distal side. The method includes forming a first hole through the concrete substrate from the proximal side that communicates with the distal side. A second hole is formed through the concrete substrate from the proximal side that communicates with the distal side. The second hole is laterally displaced from the first hole along the proximal side such that the crack lies between the first hole and the second hole. An injection valve is coupled to the first hole. A distal end of a heated hose is coupled to the injection valve. A proximal end of the heated hose is coupled to a heated hopper. The heated hopper includes a pump. A polymer rubber gel material is introduced into the heated hopper. The temperature of the polymer rubber gel in the hopper is elevated until the polymer rubber gel material can flow under pressure through the heated hose. The polymer rubber gel material is pumped at the elevated temperature through the injection valve until the polymer rubber gel material can be observed exiting the second hole.

The disclosure also includes a process for repairing a water leak through a concrete substrate. The method includes forming a first hole through the concrete substrate from the proximal side that communicates with the distal side. A second hole is formed through the concrete substrate from the proximal side that communicates with the distal side. The second hole is laterally displaced from the first hole. A polymer rubber gel material is pumped at an elevated temperature through the first hole until the polymer rubber gel material can be observed exiting the second hole. The polymer rubber gel is sufficiently viscous that the polymer rubber gel cannot be pumped when at room temperature.

The disclosure further includes a system for repairing a water leak through a concrete substrate. The system includes an injection valve, a polymer rubber gel material that comprises 99% solids, a heated tank configured to heat the polymer rubber gel material to a temperature range of 120-200° F., a pump coupled to the heated hopper and a heated delivery hose coupled to the hopper. An end of the heated delivery hose is configured to couple to an end of the injection valve.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
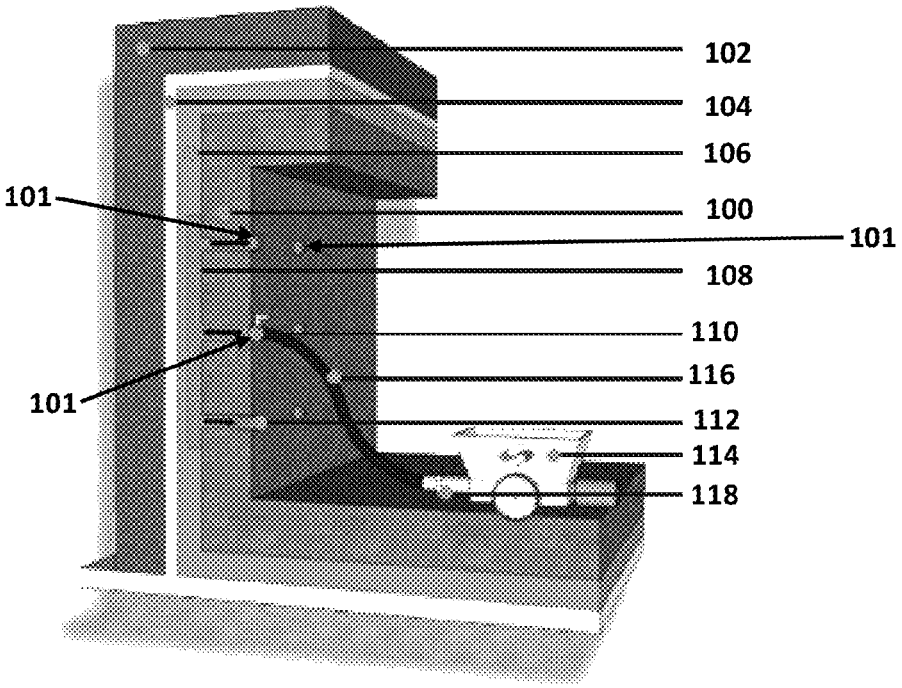
FIG. 1 is a schematic perspective cross-sectional view of a restorative waterproofing system according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring to FIG. 1, the hot injection concrete repair system is shown according to one example embodiment. The system is used to provide a restorative waterproofing membrane that seals cracks in the concrete where the injected material is applied or flows. In this embodiment, the system is being applied to a below-grade concrete wall. However, it should be recognized that the present system can be applied to any concrete or masonry substrate in any orientation or location.

The concrete wall substrate 100 shown in FIG. 1 functions to retain soil 102 and define an interior space of a structure. The concrete substrate can be a retaining wall, a basement wall, a tunnel wall or any other concrete structure that retains earth. The concrete substrate can be formed as a poured concrete, one or more precast segments, dry cast blocks (e.g. segmental wall blocks or grey block), brick and mortar, or any other structure that is intended to retain earth.

The present system and method can be applied to repair one or more cracks in the concrete wall 100 or the membrane can be established prophylactically to guard against leakage through future cracks that may form in the concrete wall 100.

Another way that a concrete wall 100 can fail and leak is where the protective layer(s) between the wall and the soil are compromised. For example, between the concrete substrate 100 and the soil 102 is a sandwich of a protective layer 104 and waterproofing material 106. If the waterproofing sandwich 104, 106 is compromised or is inadequate to prevent water passage from the soil to the concrete substrate 100, there is a substantial chance that water will penetrate through the concrete wall 100. The penetration will be even worse where the concrete wall 100 is cracked as the water will attempt to escape into the interior through the crack(s).

In order to remedy the water intrusion, a series or array of holes 101 are drilled through the concrete wall 100 as shown in FIG. 1. Preferably multiple holes 101 are drilled. At least one hole is formed on each side of the crack to be sealed. This allows flow of the chemical grout (polymer rubber gel) through a first hole (via an injection valve 110) to be monitored to ensure that the grout flows over the crack across the back side (soil facing side) of the wall 100. If the crack runs vertical, then it is particularly advantageous to have a water exit hole 112 vertically below the hole where the grout is being injected. This is because the injection volume will displace water located behind the wall and that water needs somewhere to go so that it does not form pockets within the grout region.

As shown in FIG. 1, a volume of polymer rubber gel 108 is injected through the holes 101 made in the wall 101 to form a sealed region behind the wall 100 between the concrete and the existing insulation 106 or protective layer 104.

The chemical grout in one embodiment can be a polymer rubber gel material 108. In particular, it is preferred that the polymer rubber gel comprises a sufficient solids percentage such that it is not flowable at room temperature. Most preferably, the polymer rubber gel comprises 99% solids.

Polymer rubber gel is a non-curing rubber emulsion with adhesive and cohesive physical characteristics. Polymer rubber gel never completely cures and remains in a flexible state. Since it never cures, it is capable of self-healing under application of hydrostatic pressure. Also, due to Polymer rubber gel's responsiveness to substrate movement and vibration, it makes for an excellent substance to repair cracks in concrete and/or separations in waterproofing layers.

In contrast, other chemical grouts cure and crack, leading to renewed water intrusion. The non-curing property of polymer rubber gel can weather the constant stress of thermal expansion/contraction, seismic activity and vibration that might be experienced in a wide variety of applications. The polymer rubber gel layer 108 also provides for creation of a seamless or continuous layer. Thus, there are no seams or gaps where water can easily penetrate.

Not all polymer rubber gels are the same. For example, different gels have widely differing amounts of solids in their content. Thus, any two given gels will have very different material properties. The higher the solids content, the more viscous the polymer rubber gel material will be at room temperature.

To achieve flowability (and injectability) at room temperature, a relatively thin gel such as TURBOSEAL has been conventionally used. TURBOSEAL polymer rubber gel is approximately 78% solids and can flow at room temperature. This allows the gel to be injected at typical room temperature and up to about 90° F. But such gel cannot be heated to an elevated temperature without the gel breaking down. As a result, only a modest waterproofing membrane can be formed behind the concrete wall 100. Also, the room temperature flowability means that the injected polymer rubber gel material can migrate over time, which may cause the water leakage to reoccur.

In contrast, the present invention utilizes a polymer rubber gel with a much higher solids content than TURBOSEAL polymer rubber gel and the like. The preferred gel material is not flowable at room temperature (e.g. 99% solids). That also means it is not injectable at room temperature.

One example polymer rubber gel can have the physical properties noted in the following Table 1:

TABLE 1

| | |
|---|---|
| Solids Content | 99% (ASTM D 1353) |
| Resistance to Decay | 0% moisture permeation & weight change (ASTM E 154-88) |
| Hardness | 80 (ASTM C836-89) |
| Puncture Resistance | 102 lbf (ASTM E-154) |
| Flash Point | >228° C. (ASTM D56) |
| Tensile Strength | 190 +/− 0.11 lbf (ASTM D-412-98) |
| Elongation % | 394% (ASTM C1135) |
| Hydrostatic Pressure Resistance | 169 3 lbf/in2 (ASTM D-751) |
| Adhesion to Concrete | Rating of 1—Excellent (ASTM D-412-98) |
| Crack Bridging Flexibility | No cracks (ASTM C-836-89) |
| Moisture Permeability | 0.0185 perms (ASTM E-96-80) |
| Peel Resistance | 1.01 lbf/in (ASTM D1876-08) |

In order to address the need for the preferred polymer rubber gel material to be flowable in order to be injected, the invention includes heating of the polymer rubber gel to an elevated temperature range of 120-200° F. and most preferably 150-200° F. The preferred polymer rubber gel does not break down because it is almost entirely solids.

The heating of the polymer rubber gel can be accomplished by providing a heated hopper 114 or tank where the solid blocks of gel material are deposited after removing them from their packaging. The hopper 114 then heats the solid blocks to lower the viscosity of the polymer rubber gel, which allows it to flow.

A heated hose 116 is coupled to the hopper 114 to be a conduit between the hopper 114 and the injection valve 110. The heated hose 116 helps maintain the elevated temperature of the polymer rubber gel until it reaches the point of injection because the polymer rubber gel will quickly cool upon injection.

An injection pump 118 is provided to the hopper 114 to pressurize the flow of heated polymer rubber gel from the hopper 114 and through the hose 116 so that the polymer rubber gel can be injected through the valve 110 with pressure. The flow of the heated polymer rubber gel can be regulated by operation of the injection valve 110.

Arrows are provided in FIG. 1 to indicate the direction of gel material flow during an injection process.

In use, the injection valve 110 is inserted into a first hole 101 on a first side of a crack. The hose 116 is attached to the injection valve 110. The heated polymer rubber gel is pumped under pressure through the injection valve which causes the polymer rubber gel to flow along the back side of the concrete wall 100. Once the polymer rubber gel begins to exit the second hole in the concrete wall located on an opposite side of the crack, the injection valve is closed to stop the material flow. This process can be repeated for additional spaced-apart holes until a desired restorative membrane is formed behind the wall (soil side).

After injection, the polymer rubber gel material 108 flows for a short time until it cools back to ambient temperature, which effectively solidifies the polymer rubber gel so that it cannot flow or migrate further. This solidification property at room temperature provides a far stronger water barrier and seal as compared to use of the room temperature flowable gel material. Moreover, the higher solids content of the invention combined with heating allows for better spreading and filling of cracks since the heated polymer rubber gel is less viscous at the elevated temperature as compared to the prior art polymer rubber gel at room temperature. Thus, a stronger final sealing effect can be achieved as compared to the use of room temperature flowable gel material. The increased flowability due to elevated material temperatures of the invention also makes for a quicker restoration process because the heated gel material flows quicker than the room temperature flowable gel material. The self-healing ability of the polymer rubber gel of the invention and its non-migration characteristics can also provide a permanent repair in many applications.

A waterproofing method can include injecting the heated polymer rubber gel material in more than one hole 101 separately, or simultaneously. The number of injection holes or sites employed depends on the size of the area needing to receive the restorative waterproofing membrane.

Figure 2:
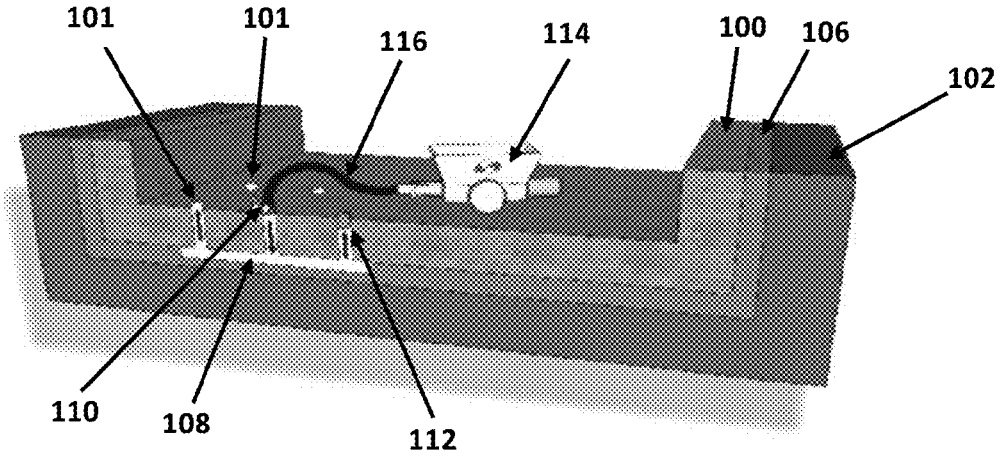
FIG. 2 is a schematic side cross-sectional view of a restorative waterproofing system according to certain example embodiments.

FIG. 2 illustrates the present invention as being applied to a concrete floor slab embodiment of a concrete substrate 100. As with the vertical wall, a plurality of holes 101 are drilled through the substrate so that the injected polymer rubber gel material 108 can reach behind the slab. One hole receives the injection valve 110 and a hole on an opposite side of a crack is monitored for the injected polymer rubber gel material to appear, which indicates that the polymer rubber gel 108 has spread at least to such radius. The plurality of holes can include at least one water escape hole 112 so that water pockets do not form within the restorative membrane. The same hopper 114 and hose 116 are used as in the wall embodiment, and the same material 108 and elevated temperature are employed.

Figure 3:
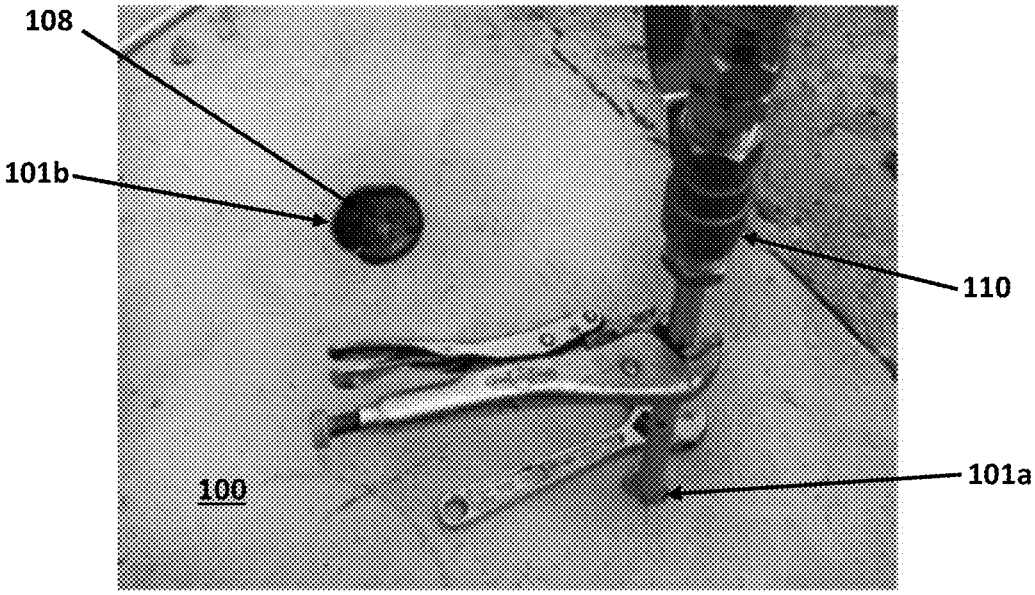
FIG. 3 is an image of a portion of a concrete floor having received a restorative waterproofing membrane according to certain example embodiments.

FIG. 3 illustrates an injection valve 110 in a first hole 101*a* drilled into a concrete floor substrate 100. A second hole 101*b* is spaced away from the injection site 101*a* and is showing the polymer rubber gel material 108 having slightly exited the hole 101*b*. This showing at the second hole 101*b* indicates that the polymer rubber gel 108 has spread behind the substrate 100 at least as far as the monitoring/water exit hole 101*b*.

Figure 4:
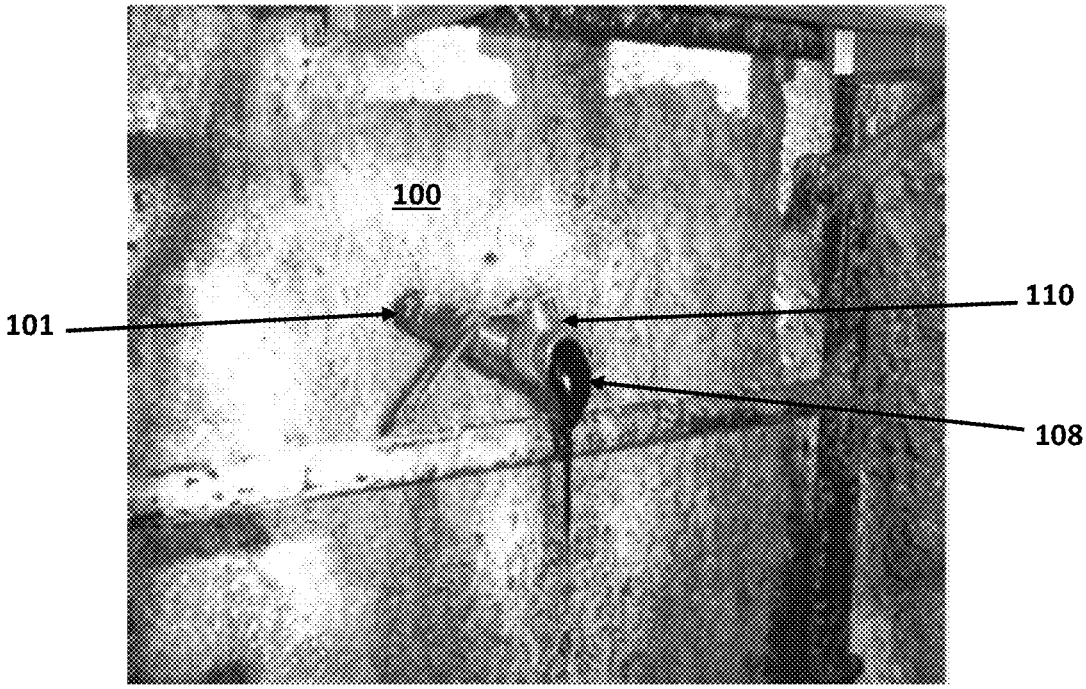
FIG. 4 is an image of a portion of a concrete wall having received a restorative waterproofing membrane according to certain example embodiments.

FIG. 4 illustrates an injection valve 110 disposed in an injection hole 101 in a concrete wall substrate 100. Note that the delivery hose has been removed. Some of the polymer rubber gel 108 that was in the valve 110 upstream of the shutoff is shown oozing from the valve opening since the gel 108 is still sufficiently heated to slightly flow.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A method of providing a restorative waterproofing membrane to a distal side of a concrete substrate that includes a crack through the substrate from a proximal side to the distal side, the method comprising:

forming a first hole through the concrete substrate from the proximal side that communicates with the distal side;

forming a second hole through the concrete substrate from the proximal side that communicates with the distal side, wherein the second hole is laterally displaced from the first hole along the proximal side such that the crack lies between the first hole and the second hole;

coupling an injection valve to the first hole;

coupling a distal end of a heated hose to the injection valve;

coupling a proximal end of the heated hose to a heated hopper, wherein the heated hopper includes a pump;

introducing a polymer rubber gel material into the heated hopper;

elevating the temperature of the polymer rubber gel material in the hopper until the polymer rubber gel material can flow under pressure through the heated hose; and pumping the polymer rubber gel material at the elevated temperature through the injection valve until the polymer rubber gel material can be observed exiting the second hole.

2. The method of claim 1, further comprising forming a water exit hole through the concrete substrate from the proximal side that communicates with the distal side.

3. The method of claim 2, wherein the water exit hole is vertically displaced below the first hole.

4. The method of claim 2, wherein the second hole is a water exit hole.

5. The method of claim 1, wherein the elevated temperature is in a range of 120-200° F.

6. The method of claim 1, wherein the polymer rubber gel comprises at least 99% solids.

7. The method of claim 1, wherein the concrete substrate is a below-grade vertically-oriented wall.

8. The method of claim 1, wherein the concrete substrate is a horizontally-oriented basement slab.

9. The method of claim 1, further comprising:

forming a third hole through the concrete substrate from the proximal side that communicates with the distal side;

forming a fourth hole through the concrete substrate from the proximal side that communicates with the distal side, wherein the fourth hole is laterally displaced from each of the first hole, the second hole and the third hole;

coupling the injection valve to the third hole; and pumping the polymer rubber gel at the elevated temperature through the injection valve until the polymer rubber gel can be observed exiting the fourth hole.

10. The method of claim 9, further comprising forming a water exit hole through the concrete substrate from the proximal side that communicates with the distal side.

11. A process for repairing a water leak through a concrete substrate, the method comprising:

forming a first hole through the concrete substrate from a proximal side that communicates with a distal side;

forming a second hole through the concrete substrate from the proximal side that communicates with the distal side, wherein the second hole is laterally displaced from the first hole; and pumping a polymer rubber gel material at an elevated temperature above room temperatures through the first hole until the polymer rubber gel can be observed exiting the second hole, wherein the polymer rubber gel is sufficiently viscous that the polymer rubber gel cannot be pumped when at room temperature.

12. The method of claim 11, wherein the elevated temperature is in a range of 120-200° F.

13. The method of claim 11, wherein the polymer rubber gel comprises at least 99% solids.

14. The method of claim 11, further comprising:

introducing a solid room-temperature block of the polymer rubber gel material into a heated hopper; and heating the solid room-temperature block of the polymer rubber gel material to the elevated temperature.

15. The method of claim 14, further comprising delivering the polymer rubber gel material under pressure at the elevated temperature through a heated hose.

16. A system for repairing a water leak through a concrete substrate, the system comprising:

an injection valve;

a polymer rubber gel material that comprises 99% solids;

a heated tank configured to heat the polymer rubber gel material to a temperature range of 120-200° F.;

a pump coupled to the heated tank;

a heated delivery hose coupled to the hopper, wherein an end of the heated delivery hose is configured to couple to an end of the injection valve.

17. The system of claim 16, wherein the polymer rubber gel material does not flow when at room temperature.

* * * * *